US005126104A

United States Patent [19]

Anand et al.

[11] Patent Number: 5,126,104

[45] Date of Patent: Jun. 30, 1992

[54] METHOD OF MAKING POWDER FOR THERMAL SPRAY APPLICATION

[75] Inventors: Vidhu Anand, Owego, N.Y.; Sanjay Sampath, Sayre, Pa.; David L. Houck, Towanda, Pa.; Jack E. Vanderpool, Laceyville, Pa.

[73] Assignee: GTE Products Corporation, Stamford, Conn.

[21] Appl. No.: 710,851

[22] Filed: Jun. 6, 1991

[51] Int. Cl.[5] ..... B22F 1/00

[52] U.S. Cl. ..... 419/12; 419/14; 419/23; 419/26; 419/29; 419/33; 419/36; 419/57; 419/65; 419/66

[58] Field of Search ..... 419/12, 14, 23, 24, 419/29, 33, 36, 57, 65, 66

[56] References Cited

U.S. PATENT DOCUMENTS

| | | | |
|---|---|---|---|
| 4,453,976 | 6/1984 | Smythe | 75/338 |
| 4,519,840 | 5/1985 | Jackson et al. | 75/255 |
| 4,725,508 | 2/1988 | Rangaswamy et al. | 75/255 |

*Primary Examiner*—Stephen J. Lechert, Jr.
*Attorney, Agent, or Firm*—James Theodosopoulos

[57] ABSTRACT

A method is disclosed for preparing an intimate mixture of powders of nickel-chromium-boron-silicon alloy, molybdenum metal powder, and $Cr_3C_2$/NiCr alloy suitable for thermal spray coatings which comprises milling a starting mixture of the above two alloys with molybdenum powder to produce a milled mixture wherein the average particle size is less than about 10 micrometers in diameter, forming an aqueous slurry of the resulting milled mixture and a binder which can be an ammoniacal molybdate compound or polyvinyl alcohol, and agglomerating the milled mixture and binder. The intimate mixture and binder may be sintered in a reducing atmosphere at a temperature of about 800° C. to 950° C. for a sufficient time to form a sintered partially alloyed mixture wherein the bulk density is greater than about 1.2 g/cc. The resulting sintered mixture may be entrained in an inert carrier gas, passed into a plasma flame wherein the plasma gas can be argon or a mixture of argon and hydrogen, and maintained in the plasma flame for a sufficient time to melt essentially all of the powder particles of the sintered mixture to form spherical particles of the melted portion, and to further alloy the sintered mixture, and cooled.

9 Claims, 6 Drawing Sheets

200X

SD 151, AFTER 500 METERS

METHOD OF MAKING POWDER FOR THERMAL SPRAY APPLICATION

BACKGROUND OF THE INVENTION

This invention relates to a method for preparing powders of nickel alloy, molybdenum, and chromium carbide/nichrome which involves milling and agglomerating, most typically followed by sintering and plasma processing. The resulting powder when used in thermal spray coating applications produced coatings which are much more uniform and have higher hardness, lower wear rates and friction coefficients when compared to coatings made from blends prepared by prior methods.

Blended powders of molybdenum and nickel self-fluxing alloys are commonly used to produce thermal or plasma sprayed coatings for various applications including piston rings for internal combustion engines. More recently there has been interest to blend chromium carbide to these powders for specific applications. Typically these blends consist of spray dried or densified molybdenum and atomized nickel alloys. When plasma sprayed to produce coatings, the coating microstructure shows large islands of molybdenum and nickel alloy. The size of these islands is controlled by the starting size of the individual component, namely Mo and the Ni alloy. This macrosegregation has its advantages and disadvantages. For instance large unreacted Mo islands are desirable because they provide the low friction coefficient (due to oxide film formation) which is advantageous for piston ring applications. The large Ni alloy rich regions provide wear resistance. However, in coatings made from such powders, while the wear rate is good, once the wear process is initiated, the propagation takes place quite rapidly because the pull-out regions are large.

Therefore it would be desirable to improve overall wear characteristics of thermal spray coatings. The hardness and wear characteristics can be further improved by addition of certain hard phases to the existing compositions of Mo/Ni alloys.

SUMMARY OF THE INVENTION

In accordance with the invention, there is provided a method for preparing an intimate mixture of powders of nickel-chrome-boron-silicon alloy, chromium carbide/-nichrome alloy, and molybdenum metal powder. The starting mixture of the two alloys and molybdenum powder is milled wherein the average particle size is less than about 10 micrometers in diameter, forming an aqueous slurry of the resulting milled mixture and a binder which can be an ammoniacal molybdate compound or polyvinyl alcohol, and agglomerating the milled mixture and binder.

In one aspect of the invention, the milled mixture and binder are sintered in a reducing atmosphere at a temperature of about 800° C. to 950° C. for a sufficient time to form a sintered partially alloyed mixture wherein the bulk density is greater than about 1.2 g/cc.

In another aspect of the invention, the resulting sintered mixture is preferably entrained in an inert carrier gas, passed into a plasma flame wherein the plasma gas can be argon or a mixture of argon and hydrogen, and maintained in the plasma flame for a sufficient time to melt essentially all of the powder particles of the sintered mixture to form spherical particles of the melted portion, and to further alloy the sintered mixture, and cooled.

DESCRIPTION OF PREFERRED EMBODIMENT

Figure 1:
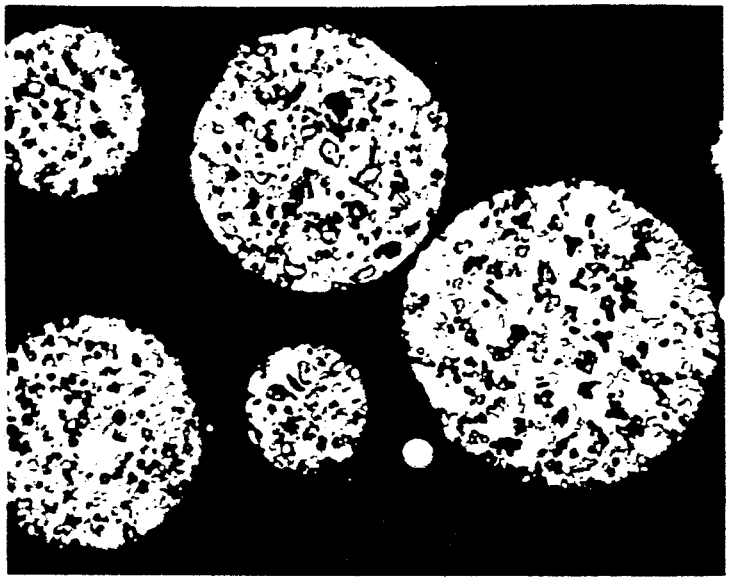
FIG. 1 is a 200X optical micrograph of SX-331 powder, a powder produced by this invention.

The present invention provides powders of molybdenum metal, nickel alloy, and chromium carbide/nichrome alloy, which, when used in thermal spray applications, result in coatings which have a uniform microstructure which is essentially free of macrosegregation. This results in high hardness and high wear resistance in the coatings.

The starting powder constituents of the present invention are molybdenum metal, nickel alloy, and chromium carbide/nichrome alloy powder. The molybdenum metal powder is typically low in oxygen, that is having typically less than about 5,000 weight ppm oxygen. One preferred source of molybdenum metal powder is supplied by GTE Corporation under the designation of Type 150. The nickel alloy powder is a Ni-Cr-B-Si alloy. The typical composition of this alloy is preferably in percent by weight about 1 to about 20 chromium, about 2 to about 5 boron, about 2 to about 5 silicon, about 0.1 to 2 carbon, and the balance nickel. The chromium carbide/nichrome powder is supplied by GTE under the designation of SX-195. The powder is 75% $CR_3C_2$ and 25% nichrome. The nichrome component is 80% Ni and 20% Cr.

A starting mixture is formed of the alloys and the molybdenum metal powder. The composition of this mixture is typically about 10% to about 50% by weight of the Ni alloy, 1% to 25% by weight of the $Cr_3C_2$/NiCr and the balance being the molybde- num powder. The preferred composition is 10% to about 30% by weight of the Ni alloy, 5% to 20% by weight of the $Cr_3C_2$/NiCr alloy, and the balance being the molybdenum powder.

The Mo, Ni alloy, and $Cr_3C_2$/NiCr alloy are normally first dry blended to form the starting mixture.

The various components in the starting mixture are then milled. The milling is done by techniques known in the art, and can be dry or wet milled. However, the preferred method is attritor milling typically using water as the milling fluid. The milling is done for a sufficient time to result in an average particle size in the powder of less than about 10 micrometers in diameter.

After the milling operation a material which is to serve as a binder in the subsequent agglomeration step is blended with the milled material. The binder can be an ammoniacal molybdate compound or polyvinyl alcohol (PVA). Usually the binder is chosen depending on the oxygen content desired in the final product powder.

Oxygen affects certain properties in the coatings such as hardness. The higher oxygen levels increase coating hardness. For example if an oxygen content of greater than about 1% by weight is desired, an ammoniacal molybdate compound is used which is typically ammonium paramolybdate or ammonium dimolybdate but is preferably ammonium paramolybdate (APM). If an oxygen content of less than about 1% by weight is desired, polyvinyl alcohol is used. Therefore some desired properties can be attained in the coatings by controlling the oxygen content with the proper binder. The binder is blended with the milled material by forming an aqueous slurry of the milled material and the binder. If the material was wet milled, the milling fluids can serve as the slurry medium. The water content of the slurry is sufficient so that it can be easily agglomerated in the subsequent processing. Usually the slurry is made of about 45% to 70% by weight solids.

The milled mixture and binder are then agglomerated to form the intimate mixture. The agglomerating is done preferably by spray drying by known methods.

The resulting intimate mixture of nickel alloy, chromium carbide/nichrome, and molybdenum metal powder can be used in thermal spray applications such as plasma spraying and high velocity flame spraying to produce coatings which have good wear properties and low friction coefficients.

The resulting agglomerated mixture can be screened typically through 60 mesh screens to remove out-of-size material, if desired.

The agglomerated material can be sintered, if desired, to form a partially alloyed mixture. The sintering is done in a reducing atmosphere preferably hydrogen at a temperature of about 850° C. to 950° C. and preferably about 900° C. to 940° C. for a period of time of typically about 1 hour to about 2 hours. The sintering results in an increase in the bulk density of the powder. The bulk density of the sintered powder is normally greater than about 1.2 g/cc and most typically about 1.5 to about 2.0 g/cc.

The resulting sintered powder mixture can be plasma processed if desired as follows to further densify and to further alloy the sintered mixture. The sintered powder is entrained in an inert carrier gas. The carrier gas is preferably argon or a mixture of argon and helium. The sintered powder and carrier gas are passed through a plasma flame. The plasma is an inert gas which is preferably argon or a mixture of argon and helium. The carrier gas and plasma gas must be inert to avoid any reactions of the powder. The powder is maintained in the plasma flame for a sufficient time at a temperature above the melting point of the powder to melt essentially all of the powder particles and form spherical particles of the melted portion.

Details of the principles and operation of plasma reactors are well known. The plasma has a high temperature zone, but in cross section the temperature can vary typically from about 5,500° C. to about 17,000° C. A typical plasma incorporates a conical thoriated tungsten cathode, a water cooled annular copper anode which also serves as a nozzle, a gas injection system and power injection system. Gases used are selected for inertness and/or energy content. These gases include but are not limited to argon, hydrogen, helium, and nitrogen. Plasma gun operating power levels are generally in the 15 to 80KW range. The location of the powder injection port varies with the nozzle design and/or powder material. It is either in the nozzle (anode) throat (internal feed) or downstream of the nozzle exit (also called external feed). The plasma jet is not a uniform heat source. It exhibits steep temperature (enthalpy) and velocity gradients which determine the velocity and temperature achieved by the injection powder particles (agglomerates). In addition, the particle trajectories (and hence the temperature and velocity) are affected by the particle size, shape and thermophysical properties. The particle temperature is controlled by appropriately selecting the plasma operating conditions (plasma gas composition and flow rate and plasma gun power) and the injection parameters (injection pot location and carrier gas flow rate). In accordance with the present invention the powder can be fed into the plasma through the internal or external feeding mechanisms. However, the internal feeding is the preferred mode.

The resulting plasma processed material is then cooled by standard techniques for this type of processing.

The resulting plasma densified material can be screened and classified to obtain the desired particle size and distribution.

The powder prepared by the method of the present invention exhibits a microstructure that has a fine and uniform dispersion of the Mo and Ni alloy with a fine dispersion of $Cr_3C_2$/NiCr when compared to prior blended powder. Thermal spray coatings produced using the powder of the present invention have improved hardness, wear and friction properties over coatings produced by conventional blending methods and also over coatings made from the prealloyed powder disclosed in co-pending application Ser. No. 527,456 filed May 23, 1990, identified as SX-314.

To more fully illustrate this invention, the following nonlimiting example is presented.

EXAMPLE

Molybdenum powder Type 150 by GTE is mixed with a Ni-15Cr-3B-4Si-3Fe alloy at about 10% to 30% by weight of the alloy, 5% to 20% by weight of $Cr_3C_2$/NiCr (75/25/80/20). The mixture is attritor milled for about 1½ to about 2 hours until the particle size of the mixture is less than about 10 micrometers in diameter. The resulting attritor milled powder is blended with about 18.7 pounds of ammonium paramolybdate and about 5 gallons of water in an agitator. The slurry is spray dried. The spray dried powder is screened-60 mesh and sintered in hydrogen for about 1 hour at an average temperature of about 900° C. The bulk density of the sintered powder is about 1.90 g/cc. The sintered powder is then plasma processed by entraining the sintered powder in an inert carrier gas and using argon or a mixture of argon and hydrogen as the plasma gas. The oxygen content in the product powder is less than 0.5% by weight. X-ray analysis of the spray dried material shows Mo and a solid solution of Ni. This powder is identified as SX-331 and an optical micrograph thereof is shown in FIG. 1.

Table I shows x-ray analysis of the densified powder and the coating of SX-331 of the present invention. /Also included in the table is x-ray data for conventional blended material of molybdenum and nickel alloy (SA-901) and of prealloyed SX-314 whose composition was similar to that of the blended SA-901 powder. It is clear in the case of both prealloyed powders (SX-314 and SX-331) that considerable alloying occurs between the Mo and Ni components.

Upon plasma spraying of the powders, the blended powder coating l(SA-901) shows very little interaction between the Mo and the Ni-alloy components as confirmed by both phase analysis and lattice parameter measurements for Mo (which shows no apparent change), Table I, In the case of SX-314 and SX-331 coatings, there appears to bé supersaturation of the dispersed phases in the Mo lattice. This is confirmed through lattice parameter measurements (Table I), which show a significant change in the Mo latice parameter. The lattice parameter decrease is associated with the accommodation of the smaller size substitutional atoms in the lattice. This effect is even more pronounced in the case of SX-331. These supersaturation effects are not surprising due to the occurrence of rapid solidification during plasma spray deposition.

TABLE I

| X-RAY DIFFRACTION RESULTS | | | |
|---|---|---|---|
| Material Condition | Major Phases | Minor Phases | Mo-Lattice Parameter |
| SA-901 Powder (Blend) | Mo and Ni-Solid Solution | — | 3.16 |
| SA-901 Coating | Mo and Ni-Solid Solution | $Cr_5B_3$ | 3.16 |
| SX-314 Powder (Prealloyed) | Mo-Solid Solution | Ni-Solid Solution $Ni_3B$, $CrSi_2$ | 3.14 |
| SX-314 Coating | Mo-Solid Solution | — | 3.11 |
| SX-331 Powder (Prealloyed) | Mo-Solid Solution | Ni-Solid Solution and $Cr_7C_3$ | 3.12 |
| SX-331 Coating | Mo-Solid Solution | — | 3.08 |

Figure 2A:
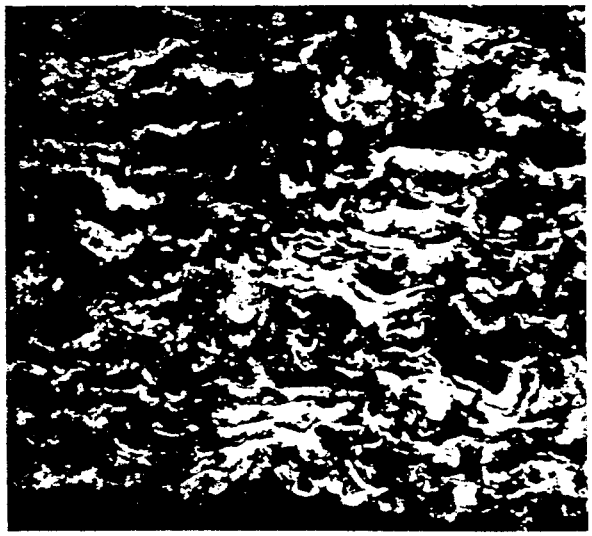
FIGS. 2*a*, 2*b*, and 2*c* are backscattered SEM micrographs of plasma sprayed coatings for SA-901, SX-314, and SX-331 powders respectively.
Figure 2B:
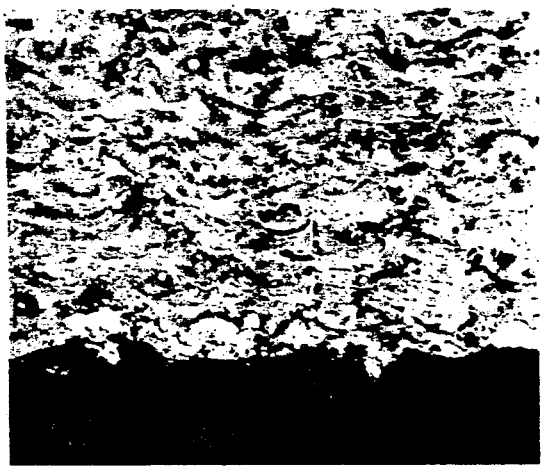
Figure 2C:
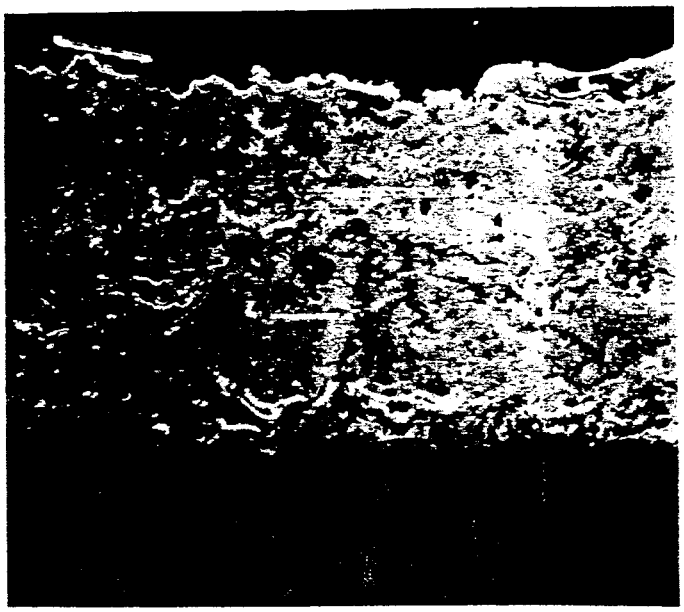

FIG. 2 compares the SEM photomicrographs of the plasma-sprayed coatings obtained from the various powders. The micrograph of the blended powder coating, FIG. 2(*a*), indicates the presence of a two-phase structure consisting of Mo (bright region) and Ni-solid solution (dark region) phases. By comparison, the prealloyed powder coatings, FIG. 2(*b*) [SX-314] and (*c*) [material of the present invention (SX-331l)] show a more homogeneous microstructure, with no visible distinction between the Mo and Ni-alloy regions. This supports the x-ray diffraction results, indicating a single phase structure in the coating.

Hardness measurements from the coatings are presented in Table II. SX-331, material of the present invention, is showing significantly higher hardness than the SA-901 (blended) and SX-314 powder coatings. The high hardness in the SX-331 material appears to be associated with the addition of hard chromium carbide phases in the matrix which is in solid solution.

TABLE II

| HARDNESS RESULTS | | | |
|---|---|---|---|
| Material | Designation | Macrohardness ($R_C$) | Microhardness ($DPH_{300g}$) |
| Mo + Ni-Alloy Blend | SA-901 | 50.3 ± 0.6 | 584 ± 113 |
| Prealloyed Mo-NiCrBSi | SX-314 | 50.5 ± 1.0 | 683 ± 89 |
| Prealloyed Mo-NiCrBSi-$Cr_3C_2$-NiCr | SX-331 | 54.5 ± 2.0 | 1046 ± 74 |

Figure 3:
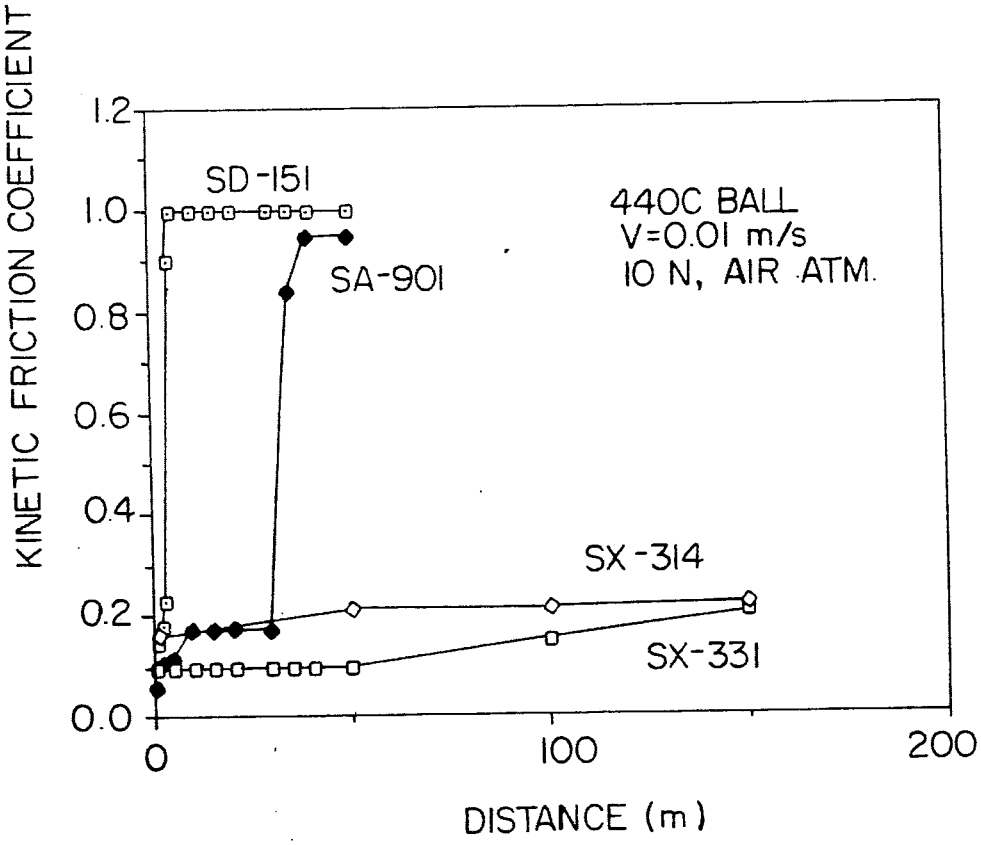
FIG. 3 shows kinetic coefficient results obtained from pin-on-disk sliding wear tests for SD-151, SA-901, SX-314, and SX-331 powders.
Figure 4A:
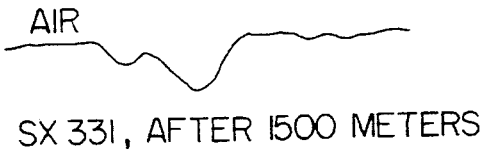
FIGS. 4*a*, 4*b*, 4*c* show coating wear scar depth measured by profilometry, a micrograph of a selected worn surface and corresponding wear effect on the ball for SX-331 powder.
Figure 4B:
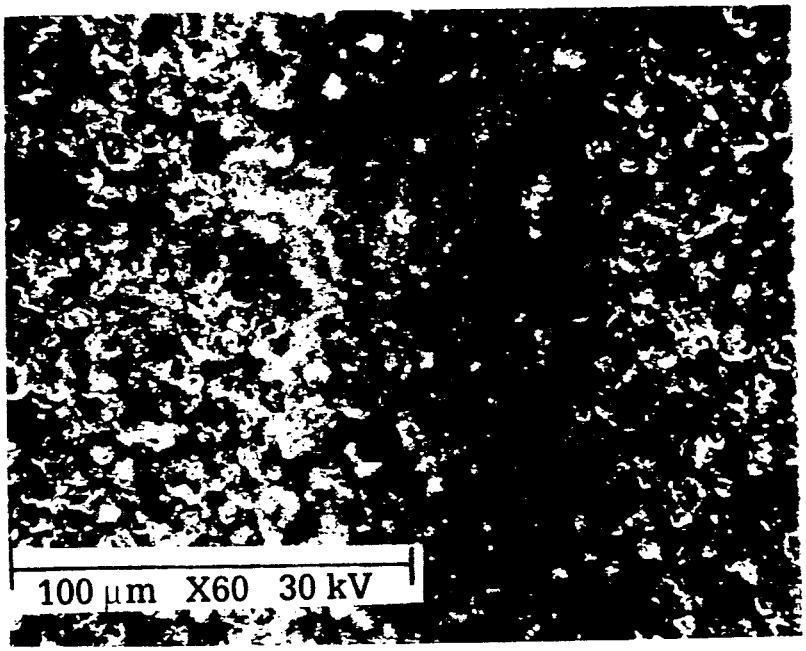
Figure 4C:
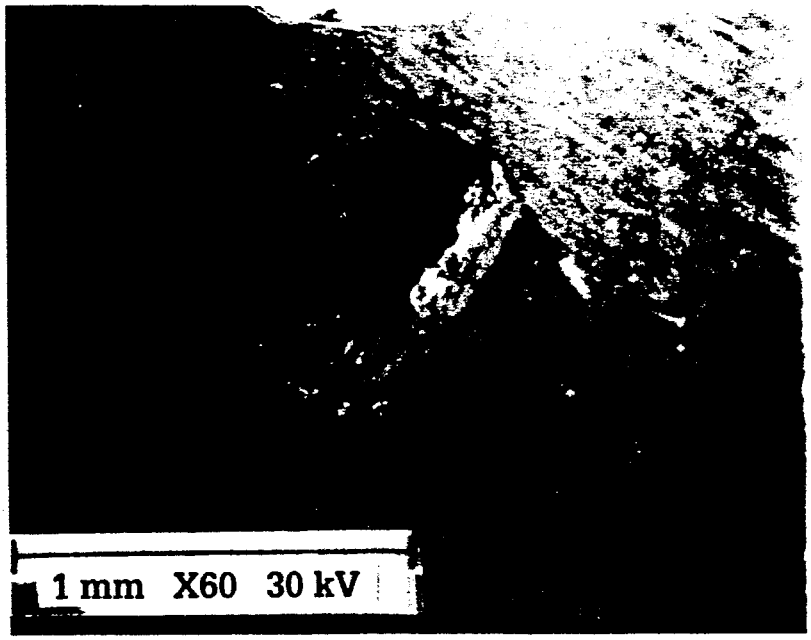
Figure 5A:
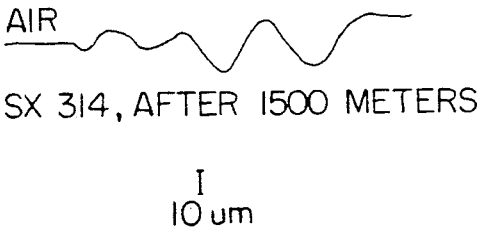
FIGS. 5*a*, 5*b*, 5*c* show the same for SX-314 powder.
Figure 5B:
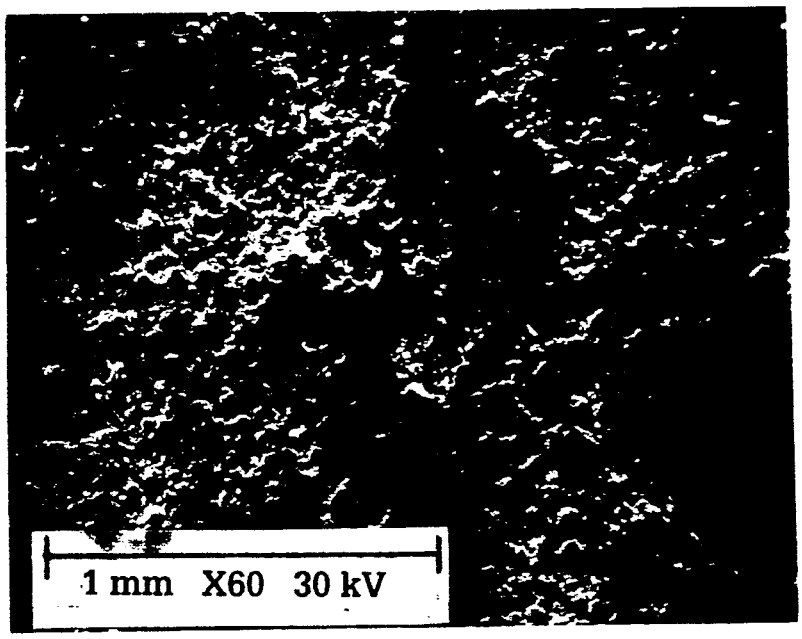
Figure 5C:
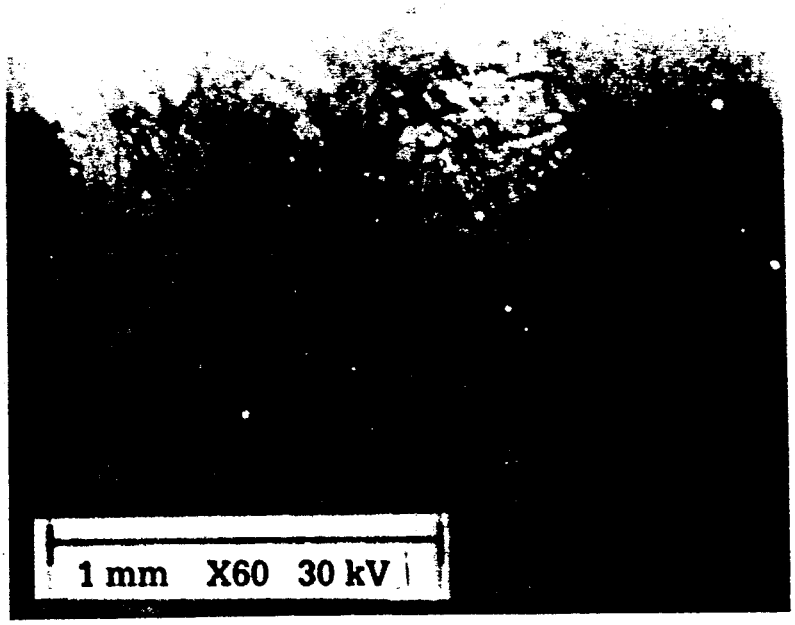
Figure 6A:
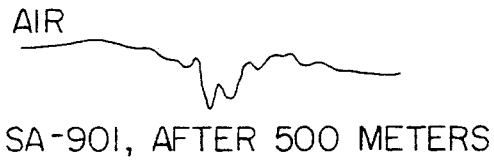
FIGS. 6*a*, 6*b*, 6*c* show the same for SA-901 powder.
Figure 6B:
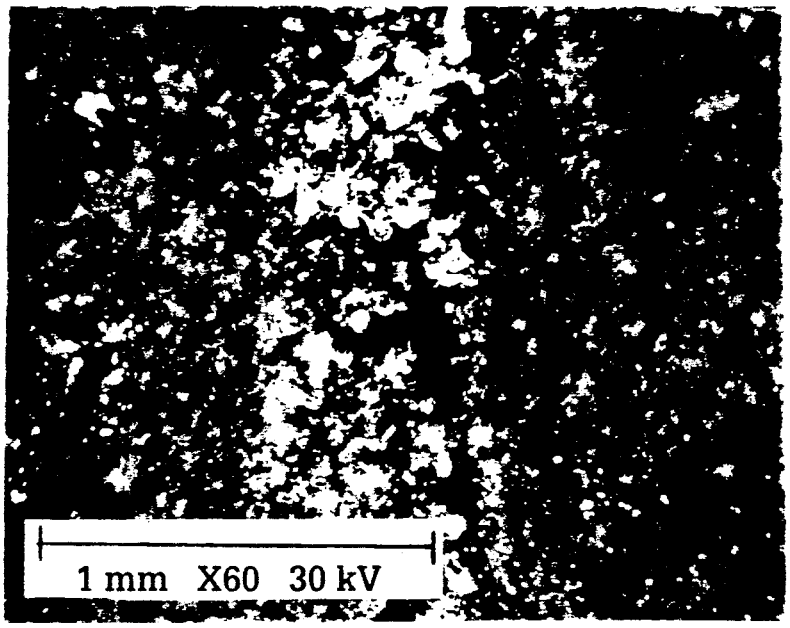
Figure 6C:
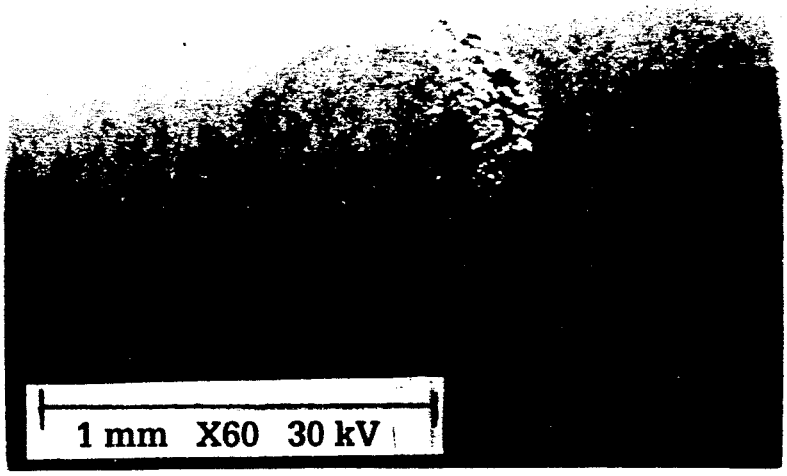
Figure 7A:
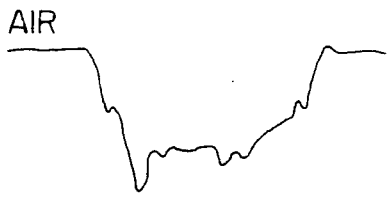
FIGS. 7*a*, 7*b*, 7*c* show the same for SD-151 powder.
Figure 7B:
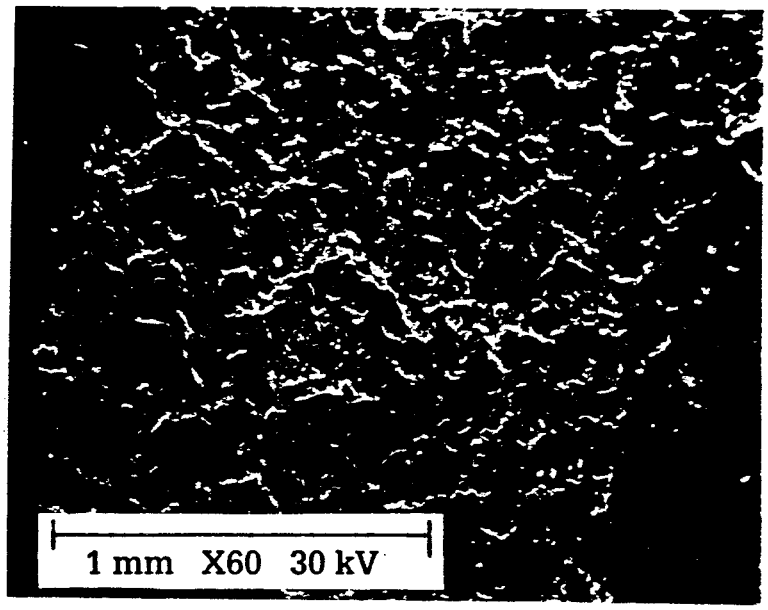
Figure 7C:
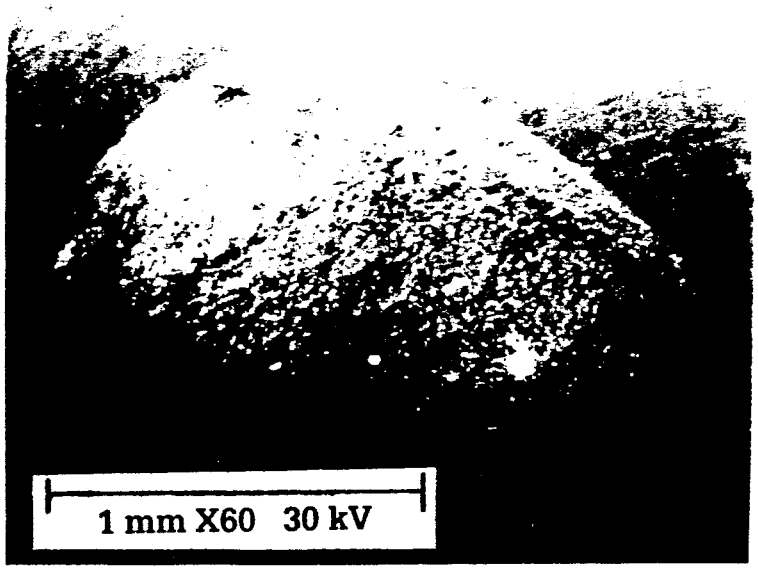

The kinetic friction coefficient results obtained from the pin-on-disk sliding wear test is shown in FIG. 3. This accelerated wear test was performed in the unlubricated condition, with hardened steel ball providing the point contact. This test generates highly localized stresses on the coating surface and provides a severe form of wear test. In the case of plasma-sprayed Mo coating (SD-151), the friction coefficient increases dramatically within 5 m of sliding. This effect is also observed in the blended material (SA-901), which offers a significantly longer life, with the breakdown in the friction properties occurring after 30 m of sliding. The prealloyed SX-314 and material of the present invention, SX-331, display a relatively low and stable frictional behavior with no evidence of increase in friction coefficient after 150 m of continuous sliding contact with 440-C steel.

FIGS. 4, 5, 6, and 7 show the coating wear scar depth measured by profilometry, the micrographs of the selected worn surfaces, and the corresponding wear effects on the ball. It is evident that the lowest wear is observed in the material of present invention. SX-314 also exhibits low wear as compared to Mo (SD-151) and blended powder (SA-901) coatings. The Mo coating (SD-151) shown in FIG. 4(*a*) indicates a larger wear track with considerable fracture, delami- nation, and pullout from the surface. Considerable wear and buildup is also observed on the ball (mating surface). The blended powder coatings (SA-901) show a smaller wear track region as compared to Mo; however, considerable delamination and pullouts are also observed, FIG. 4(*b*). The prealloyed Mo-NiCrBSi (SX-314l), FIG. 4(*c*), and prealloyed Mo-NiCrBSi-$Cr_3C_2$-NiCr (SX-331show a smaller and smoother wear track with very little delamination or fracture of the surface. The steel ball does not reveal any wear damage in the case of SX-314, thus indicating good compatibility with the coating surface. This agrees with the low friction values in FIG. 3. However, ball wear does occur with the SX-331 coating in spite of the low kinetic friction. This is thought to be associated with the high hardness of the coating. It is thus anticipated that the applicability of SX-331 would be associated in cases of more severe wear environments, with harder mating surfaces.

On the basis of the above observations, it is evident that a fine and uniform dispersion of Mo and Ni-alloy constituents in the prealloyed powder (SX-331l) strengthens the lamellae in coating through solutionizing effects, thereby improving wear resistance and frictional characteristics, when mated against hardened steel. The results also indicate that a low friction coefficient can still be maintained in the material of the present invention while improving the hardness and the wear resistance, by adding fine, hard dispersoids in a Mo matrix.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for preparing an intimate mixture of powders of nickel-chromium-boron-silicon alloy, molybdenum metal powder, and chromium carbide/nichrome alloy suitable for thermal spray coatings, said method comprising:

a milling a starting mixture of said nickel-chromium-boron-silicon alloy, molybdenum powder, and the chromium carbide/nichrome alloy to produce a milled mixture wherein the average particle size is less than about 10 micro- meters in diameter;

b forming an aqueous slurry of the resulting milled mixture and a binder selected from the group consisting of an ammoniacal molybdate compound and polyvinyl alcohol; and c agglomerating said milled mixture and said binder to produce said intimate mixture.

2. The method of claim 1 comprising the additional step of sintering said intimate mixture and said binder in a reducing atmosphere at a temperature of about 800° C. to about 950° C. for a sufficient time to form a sintered partially alloyed mixture wherein the bulk density is greater than about 1.2 g/cc.

3. The method of claim 2 comprising the additional steps of:

a entraining the resulting sintered mixture in an inert carrier gas;

b passing said sintered mixture and said carrier gas into a plasma flame wherein the plasma gas is selected from the group consisting of argon and a mixture of argon and hydrogen, and maintaining said sintered mixture in said plasma flame for a sufficient time to melt essentially all of the powder particles of said sintered mixture to form spherical particles of the melted portion, and to further alloy said sintered mixtures; and c cooling the resulting further alloyed mixture.

4. The method of claim 1 wherein said binder is ammonium paramolybdate.

5. The method of claim 1 wherein said binder is polyvinyl alcohol.

6. The method of claim 1 wherein said agglomerating is done by spray drying said aqueous slurry.

7. The method of claim 1 wherein said nickel-chromium-boron-silicon alloy consists essentially of in percent by weight about 1 to 20 chromium, about 2 to 5 boron, and 2 to about 5 silicon, about 0.1 to 2 carbon, and the balance nickel, and wherein the chromium carbide/nichrome alloy consists of 75–80% $Cr_3C_2$/20–25% NiCr.

8. The method of claim 1 wherein said starting mixture of said nickel-chromium-boron-silicon alloy, the chromium carbide/nichrome alloy and said molybdenum powder consists essentially of in percent by weight about 10 to about 30 of said nickel-chromium-boron-silicon alloy, 1–20 wt % of $Cr_3C_2$/NiCr and the balance said molybdenum powder.

9. The method of claim 8 wherein said starting mixture consists essentially of in percent by weight about 10 to about 20 of said nickel-chromium-boron-silicon alloy, 5–20% weight by of $Cr_3C_2$/NiCr and the balance said molybdenum powder.

* * * * *